United States Patent [19]

Rakov et al.

[11] Patent Number: 5,064,738

[45] Date of Patent: Nov. 12, 1991

[54] LIQUID TONING PROCESS AND APPARATUS

[75] Inventors: David M. Rakov, Rochester; Domenic Santilli, Webster, both of N.Y.

[73] Assignee: Eastman Kodak Company, Rochester, N.Y.

[21] Appl. No.: 417,147

[22] Filed: Nov. 20, 1989

[51] Int. Cl.[5] ..... G03G 13/10

[52] U.S. Cl. ..... 430/117; 430/125; 355/307

[58] Field of Search ..... 355/307; 430/125, 117, 430/45

[56] References Cited

U.S. PATENT DOCUMENTS

| | | | |
|---|---|---|---|
| 3,798,049 | 3/1974 | Kosche | 117/37 LE |
| 4,454,833 | 6/1984 | Mc Chesney et al. | 118/651 |
| 4,701,387 | 10/1987 | Alexandrovich et al. | 430/45 |
| 4,733,273 | 3/1988 | Lloyd | 355/10 |
| 4,754,302 | 6/1988 | Komatsubara et al. | 355/4 |

*Primary Examiner*—John Goodrow

*Attorney, Agent, or Firm*—Dressler, Goldsmith, Shore, Sutker & Milnamow, Ltd.

[57] ABSTRACT

A process and apparatus is provided for liquid development of a latent electrostatic image. A member bearing an electrostatic image is moved successively past (a) a toner liquid dispersion applying station wherein the latent image is developed, (b) a skiving station wherein residual liquid developer is removed, (c) a rinsing station wherein a rinse liquid is applied, and, if required, (d) another skiving station wherein residual rinse liquid is removed. the first skiving station preferably employs a conductive, resilient roller which is applied under pressure to the member and which is also initially covered with a flush liquid. The rinse liquid is preferably the toner liquid dispersion.

12 Claims, 4 Drawing Sheets

A
B
C
D
5

20
10
11
12
13
14
15
17
18
19
21
22
23
24
25
26
40
41

43
10'
11'
12'
13'
14'
15'
17'
19'
23'
24'
25'
26'
29
30
31

LIQUID TONING PROCESS AND APPARATUS

FIELD OF THE INVENTION

This invention is in the field of liquid development of electrostatic images.

BACKGROUND OF THE INVENTION

Technology for liquid toning of an electrographic latent image on an image bearing surface of a recording medium is well known. Typically, an application roll with auxiliary members is taught for applying a liquid toner or developer as a thin film to the surface of the recording medium. The roll can be submerged partially in a liquid toner (developer) bath and can be rotated at a rate sufficient to cause the developer to produce a thin film on circumferential surfaces of the roll by viscous friction. The recording medium is moved in spaced adjacent relationship to the roll. A layer of liquid toner is maintained across the gap between adjacent surfaces aided by the relative velocities involved, an electric field across the gap, and/or a suitable electrical bias between the members. Examples of such technology are shown in U.S. Pat. Nos. 3,203,395; 3,256,855; 3,367,791; 3,560,204; and 4,141,317; Jap. Utility Model Laid Open Publication 56-35634; and German Offenlegungsschrift 2,238,404.

U.S. Pat. No. 3,798,049, for example, teaches a method for developing a latent electrostatic image by roller application to such image of a viscous liquid thixotropic dispersion of polarizable toner particles in a non-polar vehicle. A thin layer of the dispersion that has a dielectric constant between 100 and 10,000 is spread over the roller's outer surface. Charged toner particles on the roller surface are thus selectively transferred to the surface of the electrostatic image.

To remove excess liquid toner from the surface of a developed image, various techniques have been taught. For example, the aforereferenced Ger. Offen. 2,238,404 describes a drying roll that is rotated in the same direction as the direction of medium movement. U.S. Pat. No. 4,454,833 teaches the use of a drying roll that rotates in a direction opposite to the direction of movement of the recording medium to remove excess toning liquid from the medium surface. U.S. Pat. No. 4,733,273 teaches a roll wiping arrangement that separates excess liquid developer from the recording medium surface. U.S. Pat. No. 4,754,302 teaches a combination of a squeezing roller unit, a recovery blade, and an air knife device.

In general, such prior art methods and apparatus suffer from such disadvantages as low operating speeds, and difficulties in removing and disposing of the relatively large quantities of residual dispersion liquids clinging to the face of the developed image. Production of high resolution toned images is difficult to achieve at high operating speeds.

SUMMARY OF THE INVENTION

The present invention provides an improved method and apparatus for accomplishing electrostatic image development using a relatively concentrated liquid dispersion, and for removing excess portions of said dispersion from the developed image.

In accordance with this invention, the dispersion is applied to a surface bearing an electrostatic image from a fountain-type applicator to develop the image after which the excess dispersion is removed from the surface by skiving, preferably with a resilient roller or blade. Thereafter, this surface is rinsed with a rinsing liquid to remove residual excess developer, and then the surface is preferably again skived, preferably by an air knife that is provided with an auxiliary vacuum-augmented liquid separation means.

The present invention permits rapid achievement of high resolution toned images. The prior art problems of excess carrier liquid removal are also overcome by the present invention.

The problems encountered with dry toner particle electrostatic image development, such as dusting and thick images which must be heat fused, are also avoided by the present invention.

The invention is preferably practiced by a process comprising the steps of successively:

(a) applying a liquid toner upon a latent image to develop said latent image;

(b) skiving the developed image surface to remove excess portions of said liquid toner; and (c) rinsing the skived surface with a rinse liquid.

If required, a fourth step can also be utilized. This step comprises skiving the rinsed surface to remove residual portions of said rinse liquid.

The apparatus of the present invention comprises in combination:

(a) a member bearing an electrostatic image;

(b) a series of three processing stations in sequential relationship to one another, the first of said stations comprising means for applying a liquid developer upon the surface of said member to develop said image, the second of said stations comprising developer skiving means to remove excess liquid developer from the surface of said member, and the third of said stations comprising means for applying a rinsing liquid to the surface of said member;

(c) means for guiding and moving said member past said series of processing stations sequentially at a predetermined velocity; and (d) control means for sequentially actuating and individually operating said stations as said member moves thereover.

The member can be a sheet, belt, drum, or other support surface.

If required, a fourth station comprising rinse liquid skiving means to remove excess rinsing liquid from the surface of said member can also be used.

While various types of apparatus can be utilized for advancing or translating the member being processed relative to the sequenced processing stations, in a presently provided apparatus embodiment, this member is fixedly positioned on a rigid platen which is continuously moved along a linear path past the stationary processing stations.

A preferred embodiment of the present invention is the provision in the dispersion skiving station of a rotatably driven skiving roll having a conductive, resilient circumferential surface whose surface speed matches the platen transport speed. The circumferential surface rotates through a bath or sump of a flush liquid. In this sump, a rotating brush is provided which is in contact with the circumferential surface of the roller. The brush functions to clean toner and counter-ions from the circumferential surface. The roller is associated with a mechanism that raises the roller against the sheet member on the platen when the platen enters the skiving station. This mechanism also applies the roller with considerable force against the sheet. Such force has been found to be important to remove substantially all the superficial residual dispersion remaining on the sheet member from the preceding station.

Nothing in the prior art teaches or suggests, following liquid development a processing sequence of skiving, rinsing, and, if required, skiving for removing residual developer from the recording medium surface. Such a sequence now offers a method and a means for overcoming such prior art problems.

The invention is capable of being practiced in a variety of modes and embodiments some of which are herein described and illustrated. However, other forms of this invention, and various additional features, advantages, aims, purposes, and the like, of this invention, will be apparent to those skilled in the art from the accompanying specification, associated drawings, and appended claims.

DETAILED DESCRIPTION OF THE INVENTION

Figures 1, 2, 3:
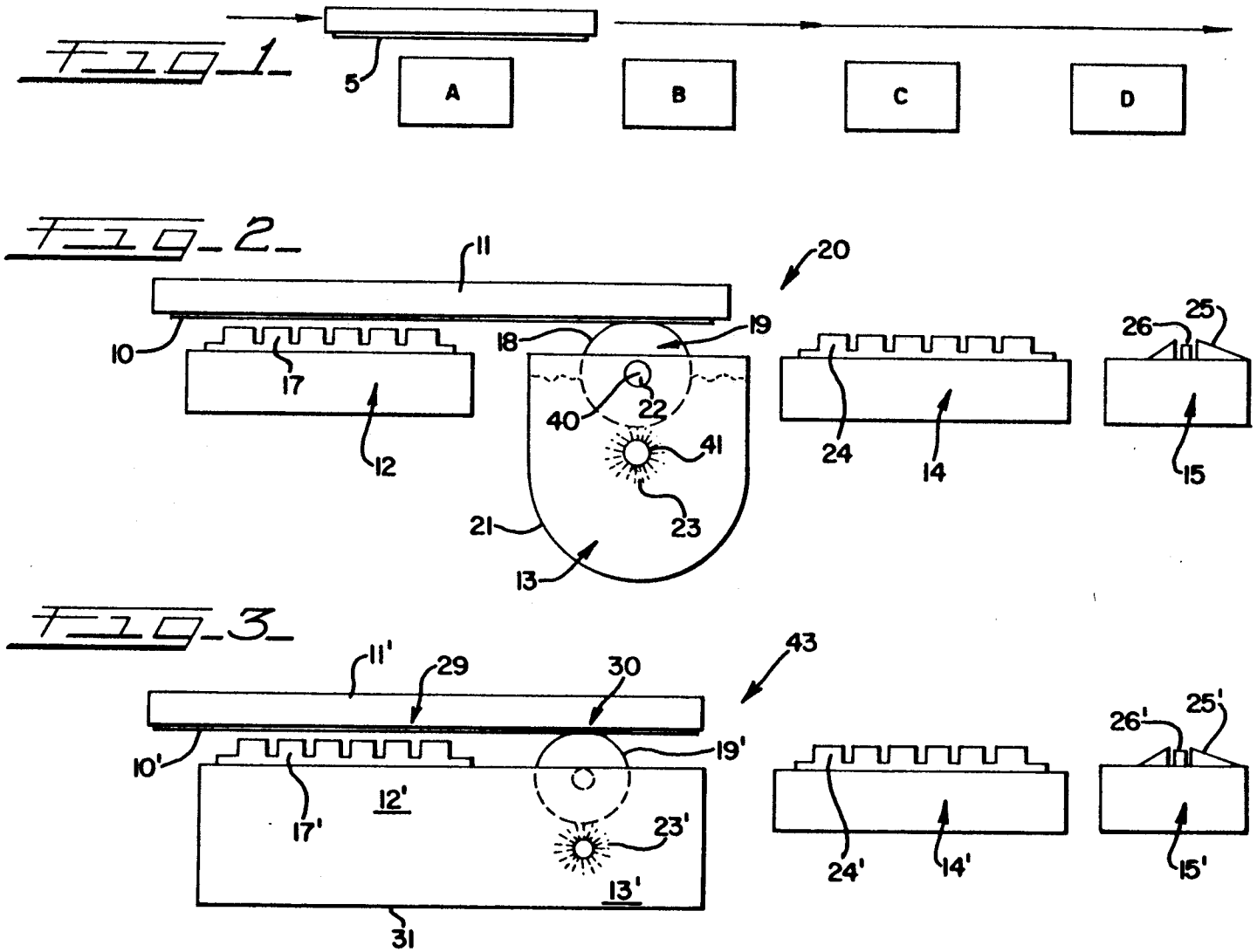
FIG. 1 is a simplified schematic flow diagram of the liquid developing process of this invention.
FIG. 2 is a diagrammatic view of one embodiment of the process shown in FIG. 1.
FIG. 3 is a diagrammatic view similar to FIG. 2, showing another embodiment of the process of FIG. 1.

Referring to FIG. 1, there is seen a flowsheet illustrating the practice of the process of this invention. A platen P has mounted thereon a recording medium in the form of a sheet S. The sheet S is capable of being electrostatically imaged with a latent image before being used as a starting material in the practice of the invention. Any conventional electrostatic imaging process known in the art can be employed in the practice of the present invention.

The sheet S, as is well known, can comprise a charge storage layer and a substrate that is conductive or has a conductive surface. The charge storage layer can be a photoconductor or a dielectric coating and the substrate can be paper or plastic.

Platen P with electrostatic image sheet S mounted thereon, is moved continuously and successively past a series of sequenced stations identified as stations A, B, C, and D in FIG. 1.

At a first station A, a liquid dispersion of toner particles is applied to the electrostatically imaged surface of sheet S. This application is accomplished by any convenient means, preferably using a fountain type applicator, with the result that the toner particles in the dispersion selectively deposit upon, adhere to, and develop the electrostatic image into a visible image.

The liquid dispersion used for development can be a member of the well known class of compositions variously known to the prior art by such terms as "liquid toner", "liquid developer", "toner", "developer", and the like. Such a composition comprises a liquid carrier having entrained toner particles of the type adapted for developing a latent electrostatic image, such as an image formed on the surface of sheet S. For purposes of practicing the present invention, it is presently preferred to employ a polymeric toner dispersed in a carrier liquid as disclosed in U.S. Pat. No. 4,659,640. The toner powder is conventional and preferably has a volume average particle size that is in the range of about less than 1 to about 8 microns. The carrier liquid preferably has a dielectric constant less than about 2.5 and an electrical resistivity greater than $10^{10}$ ohm-cm volume resistivity, like isoparaffinic hydrocarbon liquids such as Isopar G from Exxon Corp. The concentration of the toner powder in the carrier liquid is preferably in the range of about 20 to about 150 grams per liter. Additives, such as charge control agents and dispersing agents, can be present.

At a second station B, the face or surface of sheet S is skived to remove excess dispersion therefrom. While station B skiving can be accomplished by any convenient means, it is presently preferred to use a conductive resilient roller. Such a roller is preferably applied with considerable force against the sheet surface and functions to remove excess dispersion by squeezing action.

At a third station C, the face of sheet S is rinsed to remove any residual excess dispersion. Any convenient rinsing technique can be utilized; however, it is presently preferred to use a fountain applicator.

Figure 8:
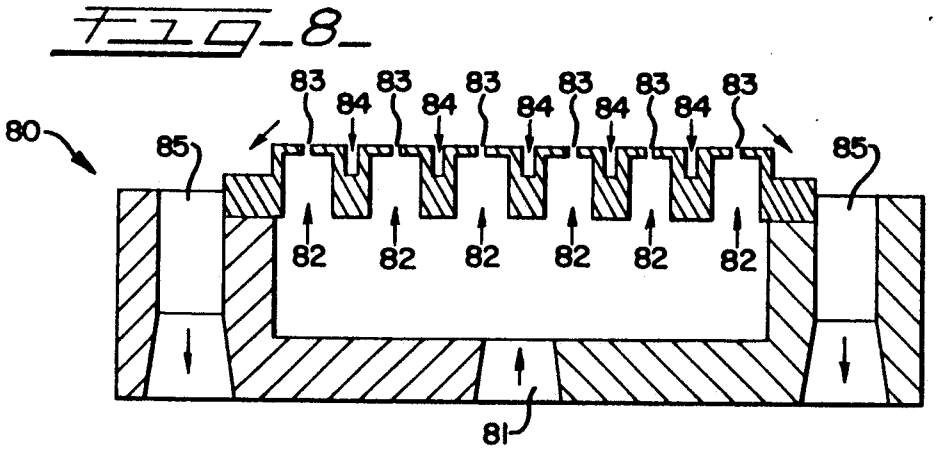
FIG. 8 is a cut-away view of a fountain-type applicator used in the practice of this invention.
Figure 9:
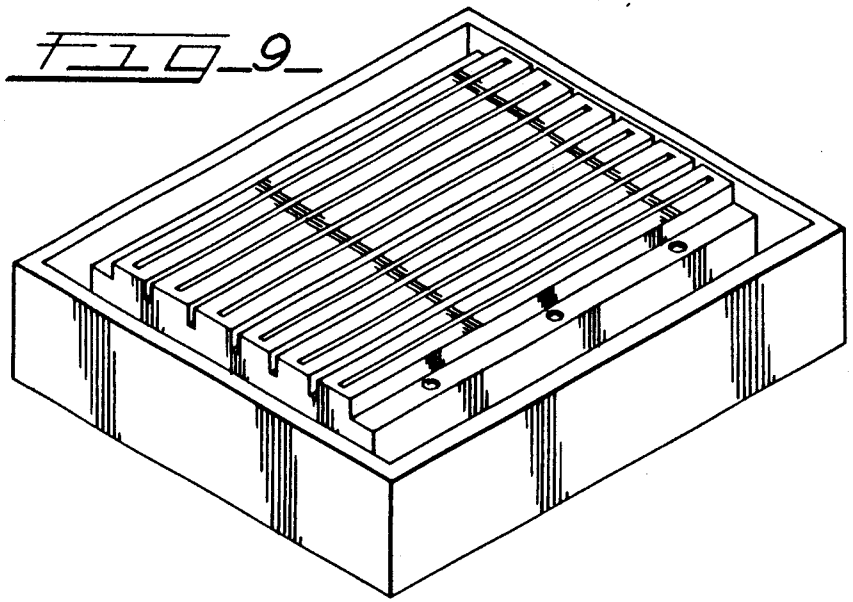
FIG. 9 is a partial perspective view of the fountain-type applicator of FIG. 8.

Conveniently and preferably, a fountain applicator is employed in both station A for dispersion application as well as in station C for rinse liquid application. A fountain applicator is shown in FIG. 8 and FIG. 9. The fountain-type applicator 80 shown in FIG. 8 has a supply line 81 and fountains 82 that disperse fluid through slits 83. Excess fluid falls into return grooves 84 and is returned to the reservoir through drains 85.

Finally, at a fourth station D, if required, the face of sheet S is skived to remove excess dispersion therefrom. While skiving at station D can be accomplished by any convenient means, including, for example, wipers, air knives, gravitational draining, flowing (optionally heated) air, and the like, it is presently preferred to employ an air knife in combination with auxiliary vacuum-augmented liquid separation means. As those skilled in the art appreciate, an air knife is a device that uses a thin flat jet of gas (usually air) to remove excess or residual coated material from a freshly coated sheet member, or the like.

Particularly in order to facilitate the skiving and rinsing actions accomplished in stations B, C and D, the platen with mounted sheet S thereon is positioned above the stations A, B, C and D along the path of platen movement.

Referring to FIG. 2, there is seen a preferred embodiment 20 of the process shown schematically in FIG. 1. An electrostatically imaged film or sheet 10 mounted on a rigid platen 11 is continuously moved over successive stages of development 12, dispersion skiving 13, rinsing or flushing 14, and rinse liquid skiving 15.

In the development station 12, a fountain-type application unit 17 as shown in FIG. 8 can be utilized.

From the development station 12, platen 11 and sheet 10 advance over the dispersion skiving station 13. Here, a resilient roller moves over the surface of the sheet 10. The skiving roller 19 is rotatably driven by a motor (not shown in FIG. 2) so that the circumferential surface 18 thereof travels at the same speed at which the platen is being linearly transported thereover, and this surface 18 is compressed perpendicularly against the sheet 10 with considerable force in order to remove most of the excess developer dispersion liquid from the film by a squeezing action. Also, the roller 19 is made of carbon-loaded rubber and is conductive to prevent accumulation of charge on the surface of the roller and allow application of an electrical bias to the roller in order to prevent removal of the toner from the sheet 10. The skive roller 19 can, for example, have a diameter of 1.5 inches and has a stainless steel shaft (0.125 inch diameter), a conductive rubber core, and a skin of Viton loaded with carbon (0.003 inch thick). The roller will have an electrical resistance of 3500 to 7000 ohms between the shaft and 1 square centimeter of its surface and a hardness of 72, Shore A. The application pressure of the circumferential surface 18 of roller 19 against the sheet 10 is preferably in the range of about 20 to 60 pounds per square inch, and more preferably in the range of about 30 to 50 pounds per square inch.

As the upper portions of surface 18 move over platen 11 and sheet 10, the lower portions of the surface 18 are immersed in a bath or sump 21 holding flush liquid. Preferably, during skiving, the roller 19 is immersed into the flush liquid in sump 21 to a level just below the drive shaft 22 of the roller 19. A rotating brush 23 is provided in sump 21. Circumferential surface portions of brush 23 are positioned so as to engage circumferential surface portions 18 of the roller 19 that are also in sump 21. The axis 40 of roller 19 is in spaced, parallel relationship to the axis 41 of brush 23. The rotating brush 23 functions to clean the circumferential surfaces of roller 19. The roller 19 is functionally associated with a lift mechanism (not shown in FIG. 2) that raises the roller 19 against the sheet 10 on the platen 11 as the forward edge of sheet 10 arrives approximately at the region of circumferential surface 18 of the roller 19, and roller 19 remains in contact with, and compressed against the sheet 10, as sheet 10 passes over the circumferential surface 18 of the roller 19. When the rear or trailing edge of the sheet 10 is reached by the circumferential surface 18 of the roller 19, the lift mechanism is retracted with the result that the roller 19 and associated components descend away from the sheet member 10 and platen 11.

From the dispersion skiving station 13, platen 11 moves over the rinsing station 14. Here, rinsing liquid is preferably applied to the surface of the film 10 by the action of a fountain-type application unit 24. Fountain-type unit 24 can have, and preferably does have, a structure and function which is identical to that of the fountain-type unit 17.

The composition of the flush liquid employed in sump 21 of skiving station 13 can vary. A present preference is to use as flush liquid either a liquid composition corresponding to the same composition as the liquid dispersion employed in development station 12, in which event the flush liquid can be periodically or continuously transferred from sump 21 to the holding tank (not shown in FIG. 2) used as the liquid dispersion reservoir for the development station, or a liquid composition corresponding to the same composition as the rinse liquid employed in the rinsing station 14, in which event the rinse liquid can be periodically or continuously transferred from the holding tank (not shown in FIG. 2) used for rinse liquid storage in rinsing station 14.

The composition of the rinse liquid employed in rinsing station 14 can vary widely. However, for reasons of operational convenience, efficiency, and process control, it has been found convenient to use a rinse liquid in station 14 which is comparable to, or even identical to, that of the carrier liquid employed in the dispersion used in development station 12.

From the rinsing station 14, the platen 11 with sheet 10 is moved over the rinse liquid skiving station 15. Here, an air knife 25 is preferably provided in combination with an auxiliary vacuum-augmented liquid separation device 26.

The combination of the air knife 25 and the vacuum separation device 26 are effective to remove substantially all of the rinse liquid from the sheet 10 which is carried forward on the surface of the sheet 10 from the rinsing station 14 to the skiving station 15.

Figure 4:
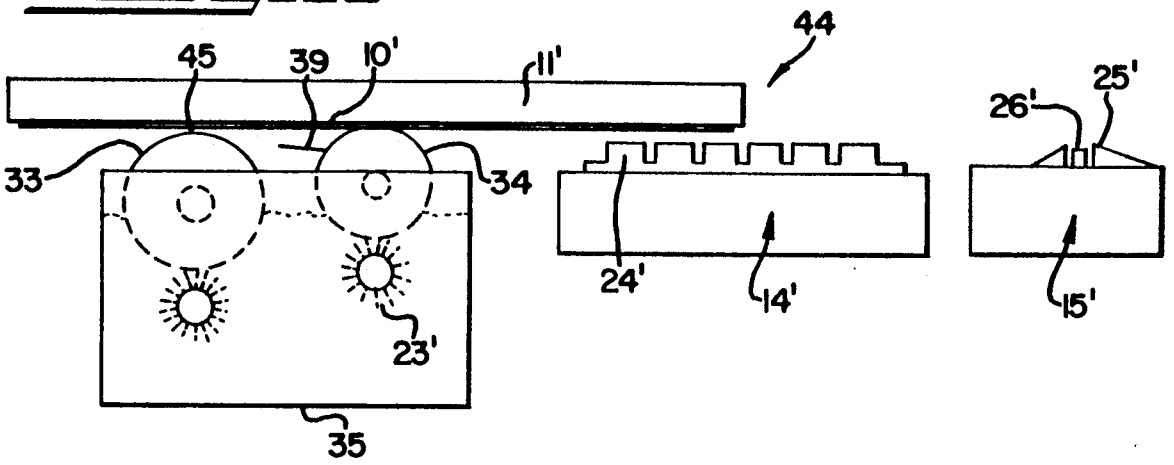
FIG. 4 is a diagrammatic view similar to FIG. 2, showing a further embodiment of the process of FIG. 1.
Figure 5:
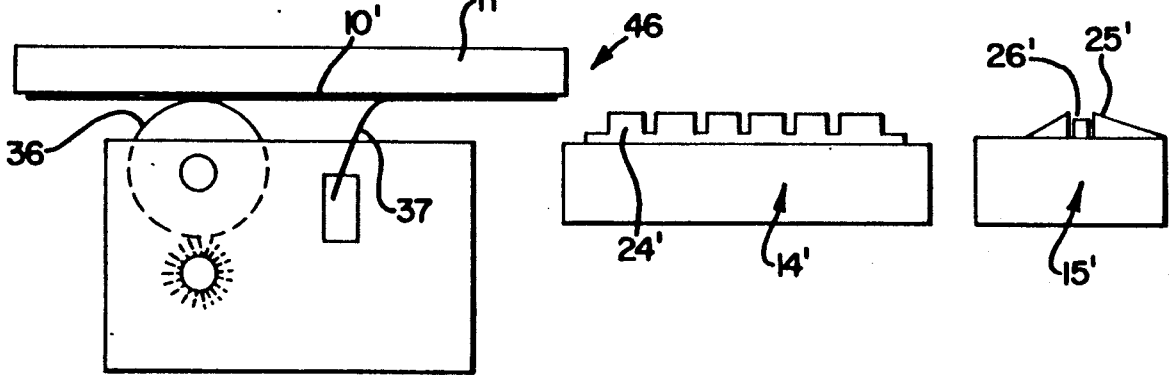
FIG. 5 is a diagrammatic view similar to FIG. 2, showing a still further embodiment of the process of FIG. 1.
Figure 6:
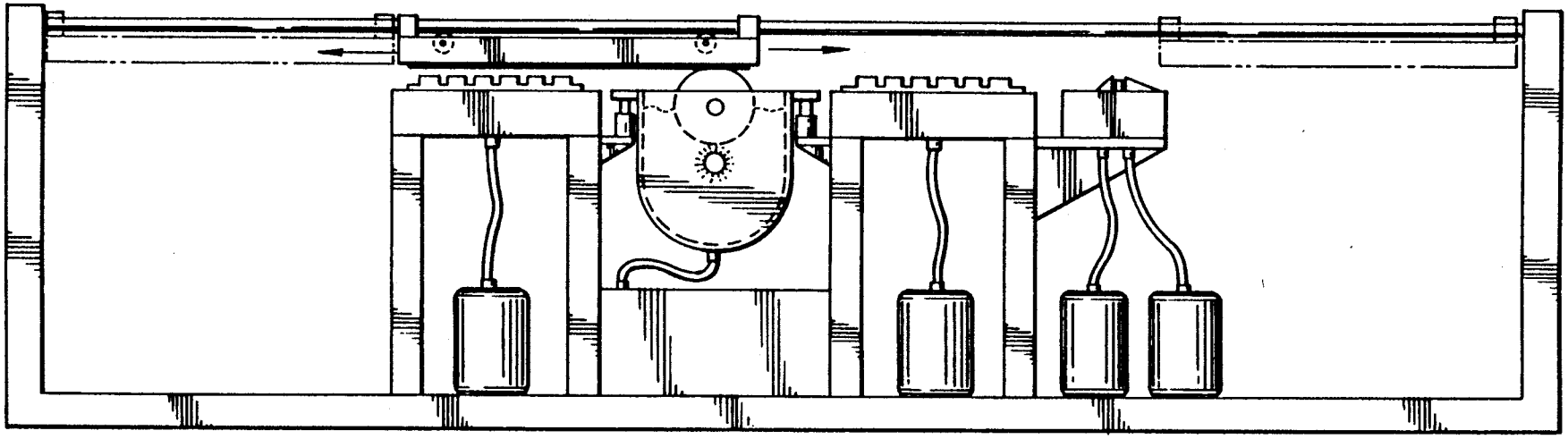
FIG. 6 is a side elevational view of apparatus suitable for practicing the process embodiment shown in FIG. 2.

The respective process embodiments shown in each of FIGS. 3, 4 and 5 employ certain components which are similar in structure and function to those employed in the embodiment 20 of FIG. 2. These similar components are identically numbered, but have prime marks added thereto for identification purposes.

Referring to FIG. 3, there is seen an alternative embodiment of the process illustrated in FIG. 1 which is designated 43 for convenience. In the embodiment 43, a dispersion skiving station 30 and a development station 29 are each disposed in the same sump tank 31. The development station 29 is structured similarly to the development station 12 of embodiment 20 and similarly functions, and the dispersion skiving station 30 is structured similarly to the dispersion skiving station 13 of embodiment 20 and similarly functions. In this embodiment 43, excess developer dispersion that is removed and recovered by the dispersion skiving station 30 is immediately returned to the developer dispersion reservoir in tank 31 for reuse by the development station 29. Thus, the need for separate or independent flush liquid is avoided in the embodiment 43.

Referring to FIG. 4, there is seen another alternative embodiment of the process of FIG. 1 which is herein designated 44 for convenience and wherein the fountain-type application unit 17 used in the development station 12 of the embodiment 20 is replaced by a conductive cylindrical applicator designated in its entirety by the numeral 33. The applicator 33 is supported for rotational movement adjacent to, but transversely across, the path of the sheet 10'. A gap 45 is located between the circumferential surface of applicator 33 and the surface of the sheet 10'. Applicator 33 is rotated by a motor (not shown). The dispersion liquid is picked up from the sump and transferred to the surface of sheet 10' during passage of the sheet 10' over the circumferential surfaces of applicator 33. A suitable applicator is disclosed, for example, in U.S. Pat. No. 4,454,833.

In embodiment 44, the dispersion skiving roller 34 is provided with an auxiliary scraper blade 39 to aid in removing toner particles from the surface of roller 34.

In embodiment 44, the applicator 33 and the dispersion skiving roller 34 (which is constructed similarly to the roller 19 used in the dispersion skiving station 13 of embodiment 20) are both positioned in a common sump tank 35 so as to achieve the same benefit that is provided by the tank 31 of embodiment 43.

Referring to FIG. 5, there is seen still another embodiment of the process of FIG. 1 which is herein designated 46 for convenience. Here, a cylindrical dispersion applicator 36 replaces the fountain-type applicator in unit 17 employed in the station 12 of embodiment 20. The operation of applicator 36 is similar to that of applicator 33 in embodiment 44. Also, in embodiment 46, the dispersion skiving roller 34, such as employed in embodiment 44, is replaced by a blade skive 37 which is positioned and configured to lightly scrape surfaces of sheet 10' during passage of platen 11' thereover. The position and stiffness of the blade skive 37 are adjusted so that the blade skive 37 skims off most of the excess developer retained on the sheet 10' without disturbing the developed image.

The applicator roll 36, and the blade skive 37, are both positioned in a common sump or tank 38 so as to achieve the same benefit that is provided by the tank 31 of embodiment 43.

Figure 7:
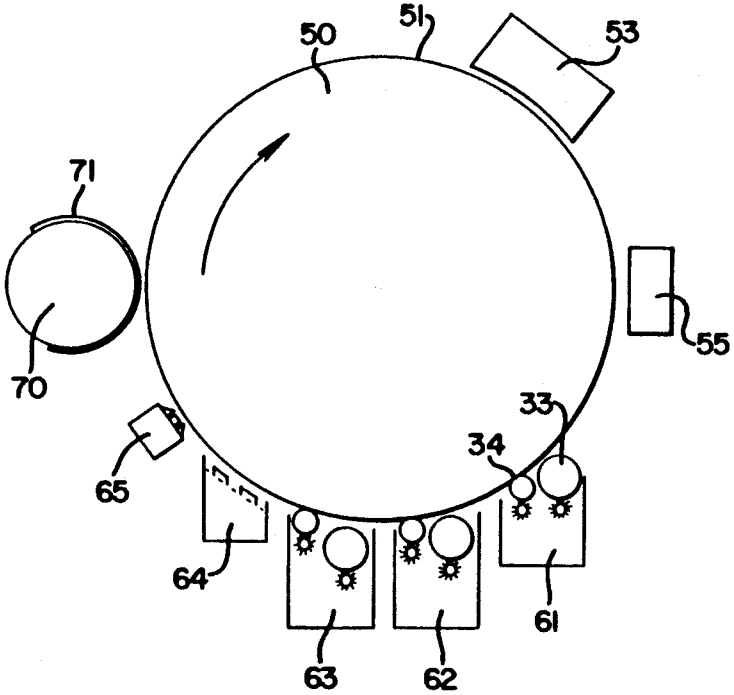
FIG. 7 is a diagrammatic view of a drum photoreceptor that utilizes the liquid developing process of this invention.

An embodiment of presently preferred apparatus for use in the practice of the process embodiment 20 is illustrated in FIG. 7.

FIG. 7 discloses the use of a drum photoreceptor to produce full color images on paper. Drum 50 has a photoreceptor on the peripheral surface 51, which rotates in the direction shown by the arrow. Corona charger 53 deposits a substantially uniform electric charge on the surface of the photoreceptor. Exposure device 55 can be an array of LEDs, which exposes the photoreceptor in an image-wise fashion as the drum 50 rotates. The incident light discharges the photoreceptor to produce an image-wise charge distribution. A separate image is written on the drum 50 for the cyan, magenta, and yellow portions of the full color image. Cyan, magenta, and yellow development stations 61, 62, and 63, respectively are used in the embodiment shown in FIG. 4. The development stations are supported by mechanisms (not shown) that allow each station to be moved upward, into engagement with the drum 50, and downward, out of engagement with the drum 50. Engagement means that the skive roller 34 is held against the drum 50 with a chosen force and the surface of the development roller 33 is a chosen distance from the surface of the drum. As the drum 50 rotates, the cyan, magenta, and yellow electrostatic images are produced sequentially by the exposure station 55. As each electrostatic image passes by, the corresponding development station engages the surface of the drum 50 to develop the image with toner. A fountain-type rinse station 64, of the type shown in FIG. 4 is also used. Each image is rinsed by this station. An air knife 65 and vacuum skive unit are also utilized to remove residual rinse fluid. A transfer drum 70 holds a sheet of paper 71 on which the final, full color image will be made. As each toned color separation image rotates past the transfer station, the transfer drum 70 bearing the paper is pressed against the photoreceptor drum and an electrical bias applied to the transfer drum to cause the toner to transfer to the paper. The three color separation toner images are sequentially transferred to the paper in register to produce the final full color image.

The invention is illustrated by the following example:

EXAMPLE 1

The process illustrated in FIG. 2 is practiced.

The sump 21 of the dispersion skiving station 13 was charged with hydrocarbon liquid consisting of the rinse liquid used in the flushing station 14 which has a composition identical to the liquid above described as employed in the sump 21.

The fountain-type application unit employed in the development station 12 and the flushing station 14 was a 3 inch long unit.

The platen 11 was operated at various transport speeds up to 10 inches per second, as shown in Table I below.

In operating this apparatus and process, it was observed that when the sheet 10 on platen 11 emerges from the development station 12, a substantial amount of the developer dispersion clings to the surface of the sheet 10. It was also observed that the roller skive 19 removes most of such excess developer liquid.

However, when the skive roller 19 was not employed, (as shown by the data given in Table I below), it was observed that, at high operating platen transport speeds of over about 2 inches per second, the rinse liquid that was applied by the fountain-type applicator in the rinse station 14 against the sheet 10 could not remove all of the excess developer clinging to the sheet 10 after it left the development station 12. Moreover, when the skive roller 19 was not used, the rinse liquid rapidly became contaminated by the developer dispersion. Hence, even if the rinse liquid were capable of removing all the excess dispersion liquid, the rinse liquid would rapidly become contaminated with large amounts of the developer dispersion, so that it would then no longer be effective as a rinse to remove residual excess developer.

It was observed that the operating skive roller 19 did remove substantially all of the excess developer dispersion present upon the surface of the sheet 10; however, the skive roller 19 was found to leave behind a thin layer of excess developer dispersion upon the sheet 10, particularly in imaged areas containing a low quantity or density of deposited toner particles, such as in the spaces between halftone dots in a lithographic print. It was observed that such thin layer of residual developer was effectively completely removed from the surface of the image in sheet 10 by the operation of the rinse station 14. In addition, the removal of such a thin residual layer of excess developer was found to be necessary for purposes of achieving high resolution durable toned images.

TABLE I

| Speed (in/sec) | Skive | Result |
|---|---|---|
| 1 | Air knife/ vacuum | Clear images with clean background. |
| 1 | Roller | Clear images with clean background. |
| 2 | Air knife/ vacuum | Clear images with clean background. |
| 2 | Roller | Clear images with clean background. |
| 10 | Air knife/ vacuum | Streaks of toner in image and background. |
| 10 | Roller | Clear images with clean background. |

The invention has been described in detail with particular reference to preferred embodiments thereof, but it will be understood that variations and modifications can be effected within the period and scope of the invention.

We claim:

1. A process for the liquid toner development of a latent electrostatic image formed on a charge retaining surface, said process comprising the steps of successively:

(a) applying a liquid toner upon said latent image to develop said latent image, (b) utilizing a conductive hard, resilient roller having cylindrical surface portions that roll over said surface and are applied against said surface at a pressure of about 20 to about 60 pounds per square inch to remove excess portions of said liquid toner; and (c) rinsing the skived surface with a rinse liquid.

2. The process of claim 1 that further comprises skiving the rinsed surface to remove residual portions of said rinse liquid.

3. The process of claim 1 wherein said applying is accomplished with a fountain-type applicator.

4. The process of claim 1 where said applying is accomplished with a conductive hard-surfaced cylindrical applicator.

5. The process of claim 1 wherein said cylindrical surface portions are covered with a flush liquid.

6. The process of claim 1 wherein said flush liquid has a composition which is similar to that of said rinse liquid.

7. The process of claim 5 wherein said flush liquid has a composition which is similar to that of said liquid toner.

8. The process of claim 1 wherein said rinsing is accomplished with a fountain-type applicator.

9. The process of claim 1 wherein said skiving of the rinsed surface is accomplished by moving an air knife over said surface.

10. The process of claim 9 wherein excess rinse liquid removed by said air knife is separated by applied vacuum.

11. Apparatus for liquid development of a latent electrostatic image formed in a charge retaining surface comprising in combination:

(a) a member bearing an electrostatic image;

(b) a series of processing stations in sequential relationship to one another, the first of said stations comprising means for applying a liquid developer upon the surface of said member to develop said image, the second of said stations comprising a conductive hard, resilient roller having cylindrical surface portions that roll over said surface and are applied against said surface at a pressure of about 20 to about 60 pounds per square inch to remove excess liquid developer from the surface of said member, and the third of said stations comprising means for applying a rinsing liquid to the surface of said member, (c) means for guiding and moving said member past said series of processing stations sequentially at a predetermined velocity, and (d) control means for sequentially actuating and individually operating said stations as said member moves thereover.

12. The apparatus of claim 11 that further comprises rinse liquid skiving means to remove excess rinsing liquid from the surface of said member.

* * * * *